US012133602B1

(12) United States Patent
McCaskill

(10) Patent No.: US 12,133,602 B1
(45) Date of Patent: Nov. 5, 2024

(54) FOLDING FOOD TRAY WITH NECK STRAP

(71) Applicant: John McCaskill, Bartow, FL (US)

(72) Inventor: John McCaskill, Bartow, FL (US)

( * ) Notice: Subject to any disclaimer, the term of this patent is extended or adjusted under 35 U.S.C. 154(b) by 151 days.

(21) Appl. No.: 17/857,234

(22) Filed: Jul. 5, 2022

(51) Int. Cl.
*F16M 13/04* (2006.01)
*A47G 23/06* (2006.01)

(52) U.S. Cl.
CPC ..... *A47G 23/06* (2013.01); *A47G 2023/0675* (2013.01)

(58) Field of Classification Search
CPC ..... A47B 23/002; F16M 13/04; A47G 2023/0675; A47G 23/0608
See application file for complete search history.

(56) References Cited

U.S. PATENT DOCUMENTS 2,039,922 A * 5/1936 Neats ..... A47G 23/0608 D7/552.2
4,135,691 A * 1/1979 Wiesmann ..... A47B 3/0809 248/439
6,675,721 B2 1/2004 Zeiders
7,516,923 B2 * 4/2009 Rossini ..... A47B 21/0314 248/118
7,806,305 B1 10/2010 Moore, Jr.
8,091,486 B1 * 1/2012 Broaddrick ..... A47B 23/002 248/444
8,157,137 B1 * 4/2012 Laird ..... A45F 3/14 108/43
8,844,448 B2 * 9/2014 Allen ..... A47B 23/002 108/43
11,503,903 B2 * 11/2022 Haddy ..... A47B 3/083
2004/0112259 A1 * 6/2004 Zeiders ..... A47B 23/041 108/43
2017/0265632 A1 * 9/2017 Johnson ..... A45F 3/005

FOREIGN PATENT DOCUMENTS

GB 533656 A * 2/1941

* cited by examiner

*Primary Examiner* — Adam J Waggenspack
(74) *Attorney, Agent, or Firm* — Sanchelima & Associates, P.A.; Christian Sanchelima; Jesus Sanchelima

(57) ABSTRACT

A folding food tray with a neck strap including a tray assembly, a strap assembly, and a leg assembly. The tray assembly comprising a first panel, a second panel, a third panel, and a fourth panel. Wherein the second and third panel are entirely between the first panel and the fourth panel. Each of said panels are arranged to be coplanar and sequentially mounted adjacent to each other about a lateral edge via a lockable hinge. The panels include a concave curve along a panels bottom edge that is in abutting contact to a user while in use. The strap assembly includes an adjustable strap that can be worn around a user's neck to use to present invention while standing up. The leg assembly includes legs mounted to the underside of the tray assembly to facilitate using the tray assembly while sitting down.

10 Claims, 4 Drawing Sheets

FOLDING FOOD TRAY WITH NECK STRAP

BACKGROUND OF THE INVENTION

1. Field of the Invention

The present invention relates to folding food tray with neck strap and, more particularly, to a folding food tray with neck strap that includes a plurality of repositionable hinged sections.

2. Description of the Related Art

Several designs for folding food tray with neck strap have been designed in the past. None of them, however, include a body worn food and beverage tray that is comprised of a tray assembly with a plurality of repositionable hinged sections that unfold to create a horizontal surface with an aperture for receiving a beverage container, the tray is supported on the wearer by use of an adjustable strap.

Applicant believes that a related reference corresponds to U.S. Pat. No. 7,806,305 issued for a body worn folding food tray with a pair of shoulder tray. Applicant believes that another related reference corresponds to U.S. Pat. No. 6,675,721 issued for a portable sporting events table with a flexible strap that encircles the user. None of these references, however, teach of a folding food tray with neck strap that includes a plurality of repositionable hinged sections that unfold to create a horizontal surface Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a folding food tray with neck strap that provide a user a lightweight tray with means to consume food and hold beverages useful at parks, sports events, restaurants, hospitals, when traveling or camping.

It is another object of this invention to provide a folding food tray with neck strap that permits a user to consume food in a comfortable way when standing up or seating down.

It is still another object of the present invention to provide a folding food tray with neck strap that is easily stored when not use.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
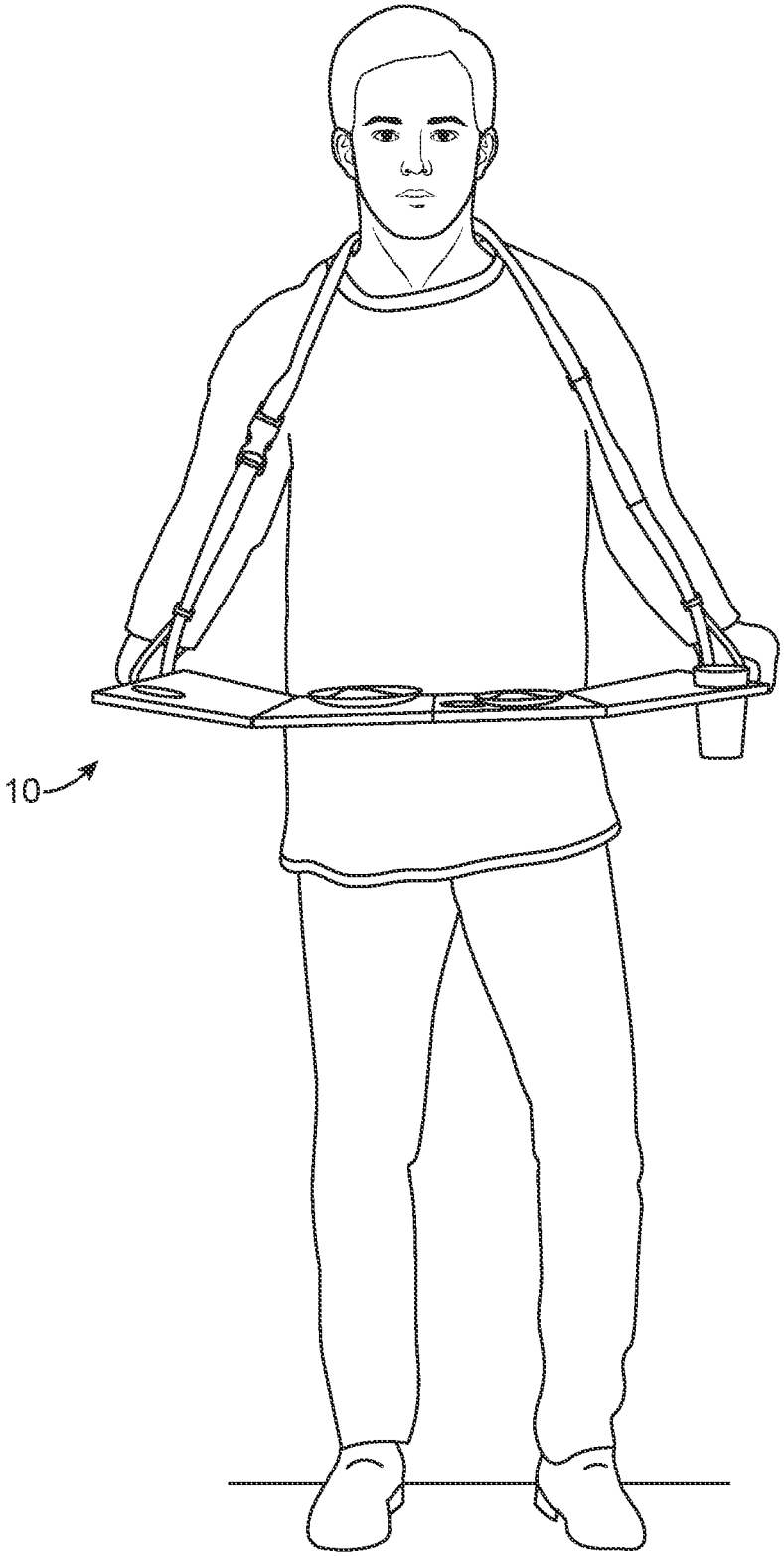
FIG. 1 represents a front operational view of the present invention 10. Wherein the present invention 10 is used to hold food and a beverage when a user is standing up.

Referring now to the drawings, where the present invention is generally referred to with numeral 10, it can be observed that it basically includes a tray assembly 20, a strap assembly 40 and a leg assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
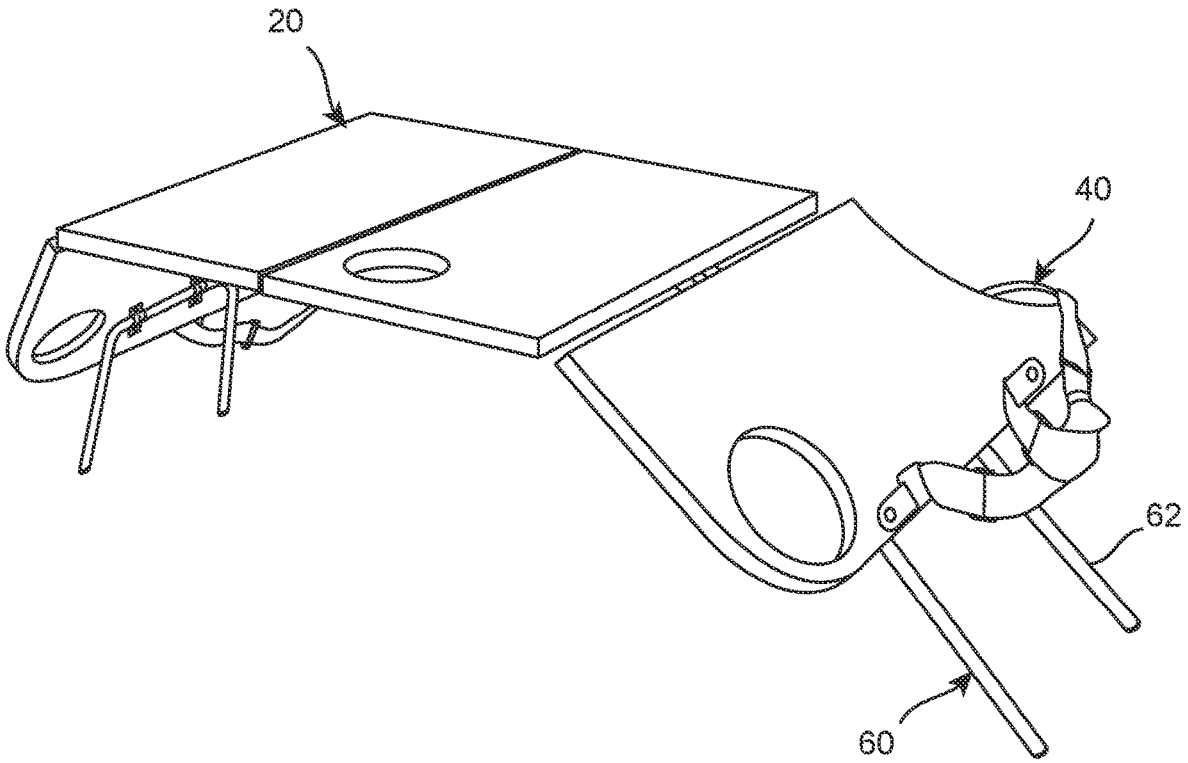
FIG. 2 shows an isometric view of the present invention 10. Wherein the tray assembly 20, the strap assembly 40 and the leg assembly 60 are depicted. It is also shown a different configuration of the present invention 10
Figure 3:
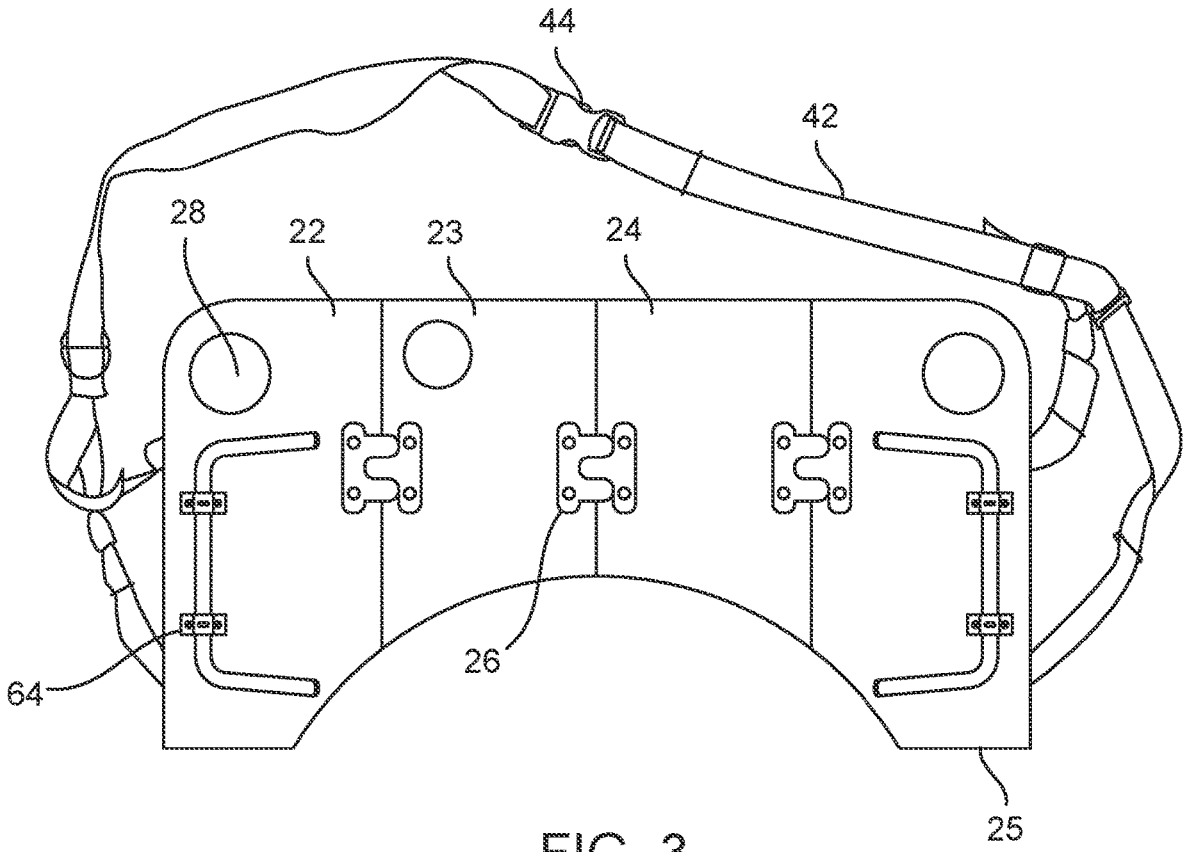
FIG. 3 illustrates a rear internal view of the present invention 10 showing a first panel 22, a second panel 23, a third panel 24, a fourth panel 25, a plurality of hinges 26, a plurality of apertures 28, a strap 42, an adjustable clasp 44 and the clamps 64 attaching the legs 62.
Figure 4:
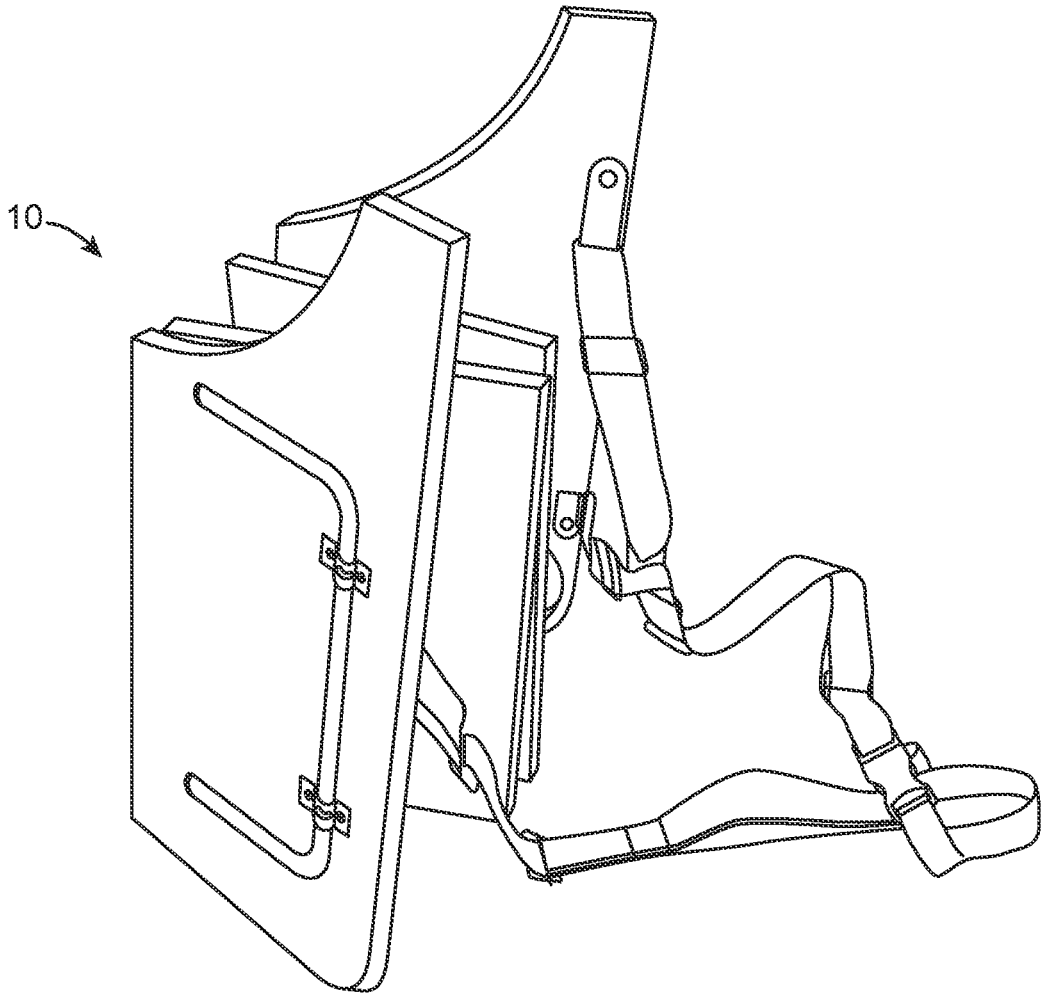
FIG. 4 is a representation of an isometric view of the present invention 10 folded which is a suitable configuration to store the present invention 10 when not used.

The tray assembly 20 includes a first panel 22, a second panel 23, a third panel 24, a fourth panel 25, a plurality of hinges 26, a plurality of apertures 28. Said first panel 22 may have a substantially rectangular shape. A bottom side of said first panel 22 may have a concave cavity shape. In other embodiments said first panel 22 may have a quadrangular shape, a triangular shape, or any variation thereof. Said first panel 22 may be made of wood, nonetheless, other materials may be used such as metal, plastic, PETG, PVC, Styrene, Polycarbonate, HDPE, and ABS, or any variation thereof. A front face of said first panel 22 may be flat. Said first panel 22 may be configured for a user to place food over. Said second panel 23 may have a substantially rectangular shape. A bottom side of said second panel 23 may have a concave cavity shape. In other embodiments said second panel 23 may have a quadrangular shape, a triangular shape, or any variation thereof. Said second panel 23 may be made of wood, nonetheless, other materials may be used such as metal, plastic, PETG, PVC, Styrene, Polycarbonate, HDPE, and ABS, or any variation thereof. A front face of said second panel 23 may be flat. Said second panel 23 may be located at one side of said first panel 22. Said second panel 23 may be configured for a user to place food or beverages over. Said third panel 24 may have a substantially rectangular shape. A bottom side of said third panel 24 may have a concave cavity shape. In other embodiments said third panel 24 may have a quadrangular shape, a triangular shape, or any variation thereof. Said third panel 24 may be made of wood, nonetheless, other materials may be used such as metal, plastic, PETG, PVC, Styrene, Polycarbonate, HDPE, and ABS, or any variation thereof. A front face of said third panel 24 may be flat. Said third panel 24 may be located at one side of said second panel 22 distal to said first panel 22. Said third panel 24 may be configured for a user to place food or beverages over. Said fourth panel 25 may have a substantially rectangular shape. A bottom side of said fourth panel 25 may have a concave cavity shape. In other embodiments said fourth panel 25 may have a quadrangular shape, a triangular shape, or any variation thereof. Said fourth panel 25 may be made of wood, nonetheless, other materials may be used such as metal, plastic, PETG, PVC, Styrene, Polycarbonate, HDPE, and ABS, or any variation thereof. A front face of said fourth panel 25 may be flat. Said fourth panel 25 may be located at one side of said third panel 24 distal to said second panel 23. Said fourth panel 25 may be configured for a user to place food or beverages over. The second panel 23 and said third panel 24 are entirely between the first panel 22 and the fourth panel 25. Each of said panels are arranged to be coplanar and sequentially mounted adjacent to each other about a lateral edge. First panel 22, said second panel 23, said third panel 24 and said fourth panel 25 include a concave curve along a panels bottom side that may be configured to be in abutting contact with a user. Said plurality of hinges 26 may be used for joining together panels. Said plurality of hinges 26 may be mounted to the rear face of said first panel 22, said second panel 23, said third panel 24 and said fourth panel 25. A first hinge of said plurality of hinges 26 may be located between said first panel 22 and said second panel 23, said first hinge may be joining together said first panel 22 and said second panel 23. A second hinge of said plurality of hinges 26 may be located between said second panel 23 and said third panel 24, said second hinge may be joining together said second panel 23 and said third panel 24. A third hinge of said plurality of hinges 26 may be located between said third panel 24 and said fourth panel 25, said third hinge may be joining together said third panel 24 and said fourth panel 25. Each hinge of said plurality of hinges may be a hinge that allow a user to sustain a position. A suitable hinge may be a torque hinge, nonetheless, other type of hinges may be used such as a ball bearing hinge, a barrel hinge, a piano hinge, or any variation thereof. Said plurality of hinges may permit the present invention to be folded or have multiple configurations as depicted in FIG. 2 and FIG. 4. Each aperture of said plurality of apertures has a circle shape, however, each aperture of said plurality of apertures may have a different shape like rectangular shape, quadrangular shape, pentagonal shape, hexagonal shape, or any variation thereof. A first aperture of said plurality of apertures 28 may be located on said first panel 22. In a preferable embodiment said first aperture of said plurality of apertures 28 may be located on a top right corner of said first panel 22, nevertheless, said first opening may be located wheresoever in said first panel 22. A second aperture of said plurality of apertures 28 may be located on said second panel 23. In a preferable embodiment said second aperture of said plurality of apertures 28 may be located on a top right corner of said second panel 23, nevertheless, said second opening may be located wheresoever in said second panel 23. A third aperture of said plurality of apertures 28 may be located on said fourth panel 25. In a preferable embodiment said first aperture of said plurality of apertures 28 may be located on a top left corner of said fourth panel 25, nevertheless, said third opening may be located wheresoever in said fourth panel 25. Said plurality of apertures 28 may be configured for a user to put beverages therein.

The strap assembly 40 includes a strap 42 and an adjustable clasp 44. Said strap may be a cloth strap, however, other material may be used such as leather, plastic, or any variation thereof. Said strap 42 may have a rectangular shape. A first distal end of said strap 42 may be couple in a rear face of said first panel 22 and a second distal end of said strap 42 may be coupled in a rear face of said fourth panel 25. Said first distal end may be coupled in a side edge of said first panel 22 opposite to an edge wherein said first hinge is located. Said second distal end may be coupled in a side edge of said fourth panel 25 opposite to an edge wherein said fourth hinge is located. In a preferable embodiment said first distal end may have a first bifurcation and said second distal end may have a second bifurcation. Said first bifurcation may be coupled to said first panel 22 in a vertical configuration. Said second bifurcation may be coupled to said fourth panel 25 in a vertical configuration. Said adjustable clasp 44 may have a rectangular shape, however, said adjustable clasp 44 may have an oval shape, circular shape, quadrangular shape, or any variation thereof. In a preferable embodiment said adjustable clasp 44 may be a strap adjuster. Said adjustable clasp 44 may be mounted in said strap 42. Said adjustable clasp 44 may be used for reducing or enlarging said strap 42.

A leg assembly 60 may include legs 62 and clamps 64. Said legs 62 may be made of metal, plastic, wood, aluminum, or any variation thereof. In a suitable embodiment said legs 62 may have a cylindrical shape, nonetheless, said legs 62 may have a cuboid shape, conic shape, irregular shape, or any variation thereof. Said legs 62 may have a substantially U shape. A first pair of legs of said legs 62 may be located on a rear face of said first panel 22. A second pair of legs of said legs 62 may be located on a rear face of said fourth panel 25. Said clamps 64 may be used to secure the legs on each rear face of the correspondent panel. The clamps 64 securing the legs 62 allow the legs to rotate inside said clamps 64. The clamps 64 allow the legs 62 to be folded in and folded out.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A folding food tray with neck strap, comprising:

a. a tray assembly, wherein said tray assembly includes a first panel, a second panel, a third panel, a fourth panel, and a plurality of hinges, wherein a lateral side of said first panel is adjacent to a first lateral side of said second panel, a second lateral side of said second panel is adjacent to a first lateral side of said third panel, a second lateral side of said third panel is adjacent to a lateral side of said fourth panel, said plurality of hinges are used to couple said panels together in the aforementioned disposition, said plurality of hinges are torque hinge wherein the first panel has a first bottom portion with a concave shape wherein the second panel has a rectangular shape the third panel has a rectangular shape, the fourth panel has a second bottom portion with a concave shape, wherein the first panel has a first aperture located at a left upper corner wherein the second panel has a second aperture located at an upper corner the fourth panel has a third aperture located at a right upper corner;

b. a strap assembly includes a strap wherein said strap is mounted to said first panel and said fourth panel, said strap is configured to be worn around a user's neck; and c. a leg assembly, wherein said leg assembly includes legs, wherein said legs are mounted on a bottom face of each of the first panel and the fourth panel wherein said leg assembly includes clamps.

2. The folding food tray of claim 1, wherein said each hinge of said plurality of hinges is a locking hinge.

3. The folding food tray of claim 1, wherein said tray assembly includes a plurality of apertures.

4. The folding food tray of claim 3, wherein said plurality of apertures are configured to hold beverages.

5. The folding food tray of claim 1, wherein said strap assembly includes an adjustable clasp.

6. The folding food tray of claim 3, wherein said adjustable clasp is a strap adjuster configured to permit a user to modify the length of said strap.

7. The folding food tray of claim 1 wherein said clamps are attached to a bottom face of each of the first panel and the fourth panel.

8. The folding food tray of claim 1 wherein said clamps allow the legs to be manually folded in and folded out.

9. A folding food tray with neck strap, comprising:

a. a tray assembly including a plurality of hinges, a plurality of apertures, a first panel, a second panel, a third panel, and a fourth panel, the second and third panel being entirely between the first panel and the fourth panel, wherein each of said panels are arranged to be coplanar and sequentially mounted adjacent to each other about a lateral edge via a hinge from said plurality of hinges, wherein the first panel has a first bottom portion with a concave shape, wherein the second panel has a rectangular shape, the third panel has a rectangular shape the fourth panel has a second bottom portion with a concave shape, wherein the first panel has a first aperture of the plurality of apertures located at a left upper corner, wherein the second panel has a second aperture of the plurality of apertures located at an upper corner, the fourth panel has a third aperture of the plurality of apertures located at a right upper corner, each hinge of said plurality of hinges is a locking hinge that sustains a desirable position, said plurality of apertures are configured to receive beverages therein;

b. a strap assembly including a strap, wherein said strap is mounted to the first panel and the fourth panel, the strap further including an adjustable clasp configured to be worn around a user's neck; and c. a leg assembly including legs and clamps, wherein said clamps are attached to a bottom face of each of the first panel and the fourth panel, the clamps allow the legs to be manually folded in and folded out.

10. A folding food tray with neck strap, consisting of:

a. a tray assembly including a plurality of hinges, a plurality of apertures, a first panel, a second panel, a third panel, and a fourth panel, the second and third panel being entirely between the first panel and the fourth panel, wherein each of said panels are arranged to be coplanar and sequentially mounted adjacent to each other about a lateral edge via a hinge from said plurality of hinges, wherein the first panel has a first bottom portion with a concave shape, wherein the second panel has a rectangular shape, the third panel has a rectangular shape, the fourth panel has a second bottom portion with a concave shape wherein the first panel has a first aperture of the plurality of apertures located at a left upper corner, wherein the second panel has a second aperture of the plurality of apertures located at an upper corner, the fourth panel has a third aperture o the plurality of apertures located at a right upper corner the disposition in which said panels are mounted together is said first panel is adjacent to said second panel, said second panel is adjacent to said third panel, said third panel is adjacent to said fourth panel, each hinge of said plurality of hinges is a torque hinge that holds said panels at desirable angles, said plurality of apertures are configured to receive beverages therein;

b. a strap assembly including a strap, wherein said strap is mounted to a top portion of the first panel and to a top portion of the fourth panel, the strap further including an adjustable clasp, said adjustable clasp further including a strap adjuster, said strap is configured to be worn around a user's neck, said strap adjuster clasp is configured to permit a user to modify the length of said strap to be suitable for a user when use; and c. a leg assembly including legs and clamps, wherein said clamps are attached to a bottom face of each of the first panel and the fourth panel, the clamps allow the legs to be manually folded in and folded out, the legs have a U-shape.

* * * * *